US005997441A

United States Patent [19]

Kranz et al.

[11] Patent Number: 5,997,441

[45] Date of Patent: Dec. 7, 1999

[54] GYMNASTIC APPARATUS

[76] Inventors: Christoph Kranz, Chlodwigphad, D-52385 Nideggen; Toni Kribben, Louisenstrasse 29, D-50374 Erfstadt, both of Germany

[21] Appl. No.: 09/097,224

[22] Filed: Jun. 12, 1998

[30] Foreign Application Priority Data

Jun. 13, 1997 [DE] Germany ..... 297.10.221
Jul. 29, 1997 [DE] Germany ..... 297.13.435

[51] Int. Cl.[6] ..... A63B 6/00

[52] U.S. Cl. ..... 482/23; 482/52; 482/142

[58] Field of Search ..... 48/23, 27, 44, 48/47, 48, 52, 121, 142, 51; 472/137, 93, 94; 446/486, 334, 333, 336

[56] References Cited

U.S. PATENT DOCUMENTS

| | | | |
|---|---|---|---|
| 2,119,327 | 7/1938 | Gunnarson | 472/93 |
| 2,243,943 | 6/1941 | Bunting | 472/93 |
| 2,269,095 | 3/1942 | Davis | 446/334 |
| 2,603,034 | 7/1952 | Whitlock | 446/334 |
| 2,726,866 | 6/1955 | Nally | 472/93 |
| 4,478,420 | 10/1984 | Sowards | 273/411 |
| 5,458,551 | 10/1995 | Shenton | 482/83 |
| 5,697,870 | 12/1997 | Osborn | 482/52 |

*Primary Examiner*—Jerome W. Donnelly
*Assistant Examiner*—Tam Nguyen
*Attorney, Agent, or Firm*—Foley, Hoag & Eliot LLP

[57] ABSTRACT

The gymnastic equipment described herein is characterized by a rectangular platform which is preferably about 30–50 cm wide and about 75–150 cm long. Vertical supporting members are arranged at the four comers of the platform. A resilient elongated rope-like member is looped around the four supporting members and is height-adjustable. The height of the rope can be set so as to enable a combination of muscle exercises with simultaneous aerobic and/or choreographic workouts free of interruption. Particular skills for fixing the resilient rope on arms or legs are not necessary during the sequence of exercises. A securing device is attached to each supporting member to retain the member at the set height.

24 Claims, 2 Drawing Sheets

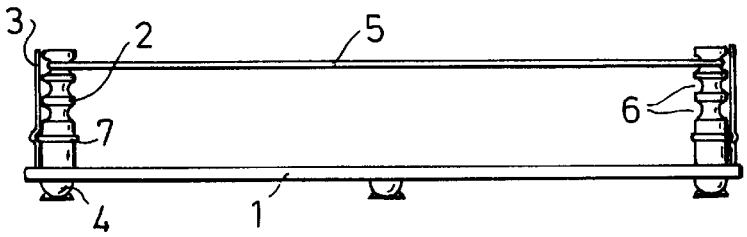
FIG.1
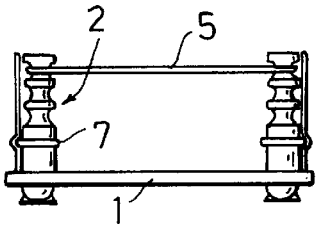
FIG.2
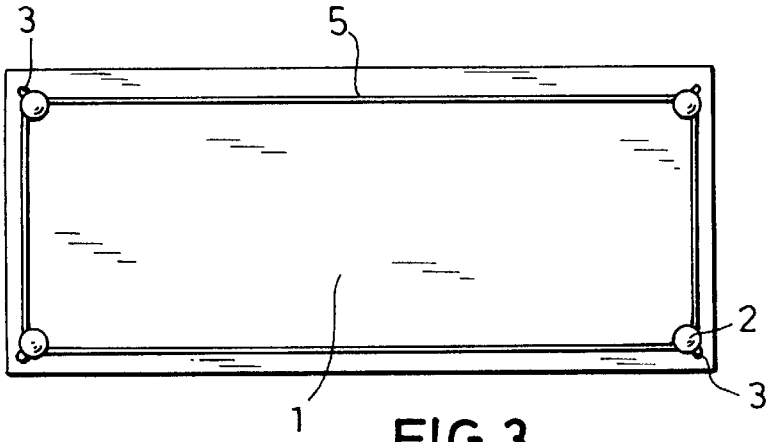
FIG.3
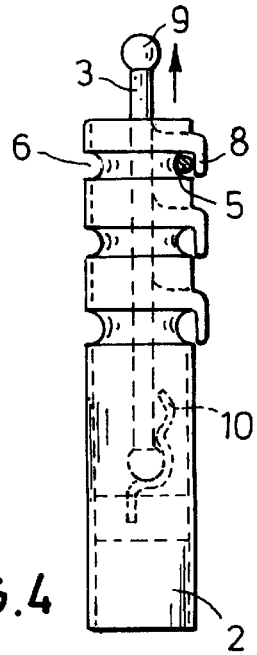
FIG.4
FIG.6
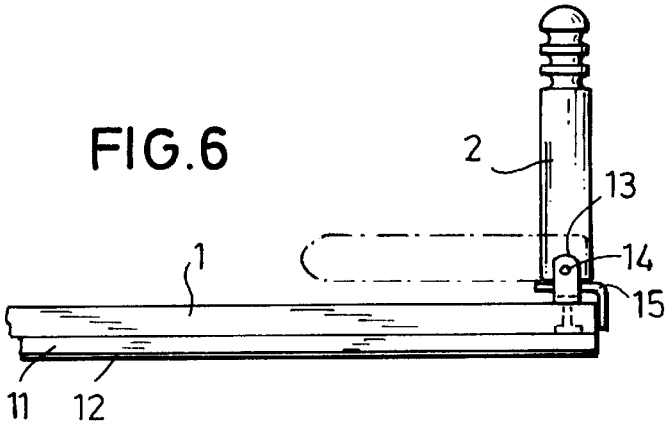
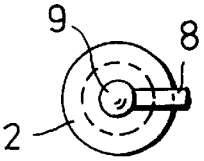
FIG.5

GYMNASTIC APPARATUS

BACKGROUND OF THE INVENTION

The invention relates to a gymnastic apparatus which is particularly suitable for performing cardiovascular exercises and muscle training in aerobic sports.

In many aerobic sports, weight bearing or resistance devices, such as dumbbells and expander belts, are used in order to train arm and leg muscles. Furthermore, so-called step exercising devices are known which have lugs for accommodating a rubber ring or other expander with which a right or left leg can be trained.

The known apparatuses permit one to train arm and leg muscles. However, rapid workout sessions for exercising both arms and both legs are not possible with these known apparatuses, because in each case, the expander belts have to be manually inserted or slipped over a securing device.

It is therefore an object of the present invention to provide a gymnastic apparatus for both muscle training and cardiovascular exercise which eliminates the interruptions or breaks in the training exercises experienced with devices utilizing conventional expander belts or ropes as stress elements, so that the exercises for exercising the muscles of both arms and both legs can be combined, much like a dance.

SUMMARY OF THE INVENTION

The object of the invention is achieved with a gymnastic apparatus having a rectangular platform, preferably with a width of from about 30 to about 50 cm and a length of from about 75 to about 150 cm. Vertical supporting members are arranged at the four corners of the platform. A resilient rope or rope-like member is looped around the four supporting members in such a manner as to be height-adjustable. The resilient rope is preferably retained on the supporting members in grooves provided with nubs or other elements arranged near the outer opening of the grooves for locking or holding the resilient rope in place.

One of the advantages of this apparatus is that both the height and the tension of the resilient rope can be adjusted so as to enable a combination of muscle exercises with simultaneous aerobic and/or choreographic workouts free of interruption. Particular skills for fixing the resilient rope on arms or legs are not necessary during the sequence of exercises.

In one embodiment of the invention, a securing device for securing the resilient rope to the supporting member is attached to each supporting member. The securing devices are movable between an open and closed position. In the closed position, the securing device retains the resilient rope at the set height. The resilient rope is thereby reliably prevented from becoming detached and flying or slipping off, thus minimizing the risk of injury during the exercises.

In another embodiment, the securing device consists of a height-adjustable rod passing through the supporting member and including a knob and hooks, wherein the number of hooks corresponds to the number of grooves in the supporting member adapted to engage the resilient rope. The securing device preferably is held in the open position, e.g., by a spring catch or similar spring-loaded mechanism.

In yet another embodiment of the invention, the supporting members are pivotally mounted on said platform so as to be rotatable by about 90° against the resistance of a spring. This feature permits efficient transport and space-saving storage of the apparatus.

In still another embodiment, attachment devices such as hooks or lugs can be attached to the edge of the said platform for attachment of one end of an expander-like resilient belt which can be fitted with a holding device, e.g., a handle. Alternately, the attachment devices can be attached to the supporting members.

Preferably, the platform is made of wood, plastic, fibrous material or the like and is designed and constructed in such a way as to be capable of cushioning and absorbing the step of the user treading on the platform, thus protecting the muscles and joints, in particular the leg and foot joints, of the exercising person. The platform is advantageously provided on the upper surface and/or bottom surface with layers and/or support members made of cushioning and/or non-skid material.

The resilient rope can be any elongated rope-like member, e.g., a rope, belt, string, cord, band or other elongated flexible structure. The rope can be made of any resilient, stretchable, elastic material which, after being, stretched, will return substantially to its original configuration. Exemplary materials useful for the resilient rope include, for example, elastic rubbers and plastic materials.

Preferred embodiments of the invention will be described hereinafter in greater detail with reference to the appended drawings.

BRIEF DESCRIPTION OF THE DRAWINGS

In the drawings is shown in:

FIG. 1 a lateral view of an embodiment of the present invention;

FIG. 2 a front view of the embodiment of FIG. 1;

FIG. 3 a top view of the embodiment of FIG. 1;

FIG. 4 an enlarged view of a supporting member of the embodiment of FIG. 1, shown with a rope securing device of the invention;

FIG. 5 a top view of the supporting member of FIG. 4;

FIG. 6 a side view of a second embodiment of the invention;

DETAILED DESCRIPTION OF THE PREFERRED EMBODIMENTS

Figure 7:
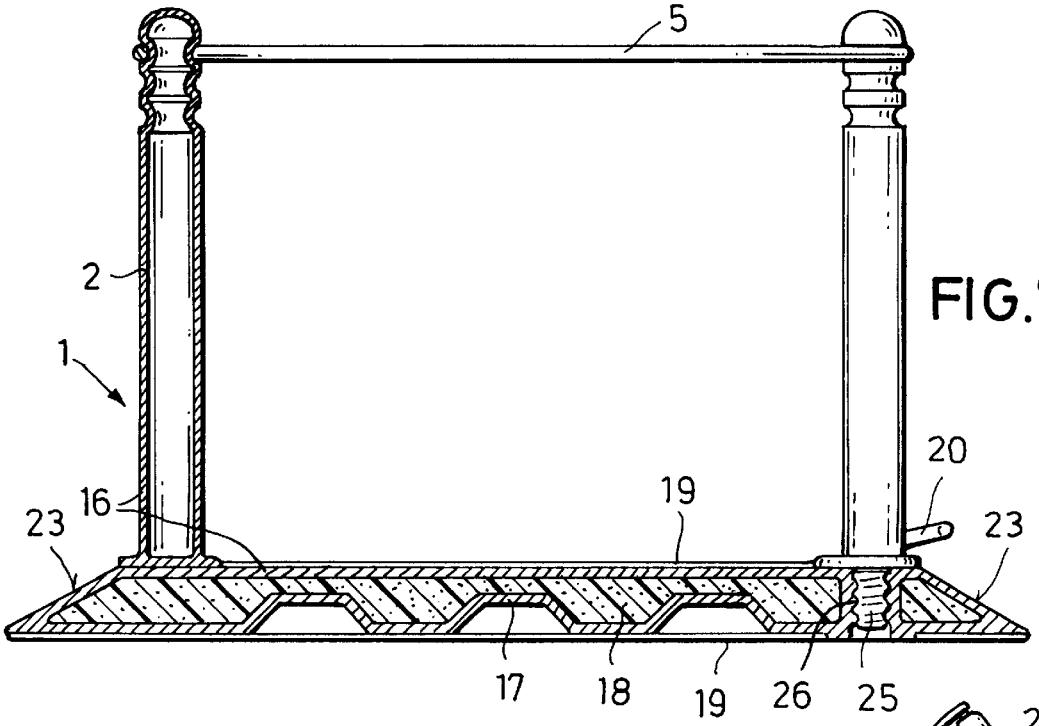
FIG. 7 a front view of a third embodiment of the invention.

As shown in FIGS. 1 to 3, the gymnastic apparatus consists of a rectangular platform 1, preferably from about 30 to about 60 cm wide and, from about 75 to about 150 cm long. At the four comers of platform 1, vertical supporting members 2 are arranged. A height-adjustable resilient rope 5 is looped around the supporting members 2. The supporting members 2 preferably are dimensioned to permit the height of the resilient rope 5 to be adjusted to a desired height. For example, in the embodiment shown in FIG. 1, resilient rope 5 is about 15 cm high (i.e., measured from the platform surface). IN this embodiment, the height of the resilient rope 5 may be adjusted within a range of from about 10 to about 20 cm. However, the supporting members may be designed to accommodate any height range desired.

The supporting members 2 are preferably provided with grooves 6 which enable a gradual height adjustment of the resilient rope 5. These grooves are dimensioned that they can at least partially accommodate the resilient rope 5. The deeper these grooves 6 are, the more securely the resilient rope 5 is held by the supporting members 2. On the supporting members 2 securing devices 3 are provided which after insertion of the resilient rope 5 can be secured to the supporting member so that the resilient rope 5 cannot slip or escape from the selected groove. The securing device 3 shown in FIGS. 1 to 3 is formed by a simple rod which is hingedly attached to the supporting member 2 and held in its lower area to the supporting member by a holding device, such as a rubber ring 7. Means other than a rubber ring for holding the rod to the supporting member may be used, for example, a metal band or clasp or a cloth band.

In the embodiment depicted in FIGS. 4 and 5, the securing device 3' comprises a height-adjustable rod moveably disposed within the supporting member 2, with a knob 9 and hooks 8 attached to the rod, wherein the number of hooks corresponds to the number of grooves 6. The hooks 8 extending outwardly from a slot in the supporting member 2 and grip from the outside the resilient rope 5 positioned in one of the grooves 6.

In FIG. 4 rope securing device 3' is shown in the closed position. By raising the knob 9 the securing device 3' comes to rest in a spring catch 10 securing the securing device 3' in the open position. After inserting the tensioned resilient rope 5 into the desired groove 6, the securing device 3' can be pressed down until it reaches an end stop and is secured in that end position.

Resilient cushioning feet 4 preferably are provided on the underside of platform 1. The contact area of the feet 4 on the platform preferably comprises a non-friction non-skid material, e.g. rubber or latex, so that the gnastic apparatus cannot slip during the exercises.

As shown in FIG. 6, the underside of platform 1 can, however, alternatively be fitted with a layer 11 made of a resilient cushioning material, e.g., foam or cellular rubber. Here, too, the contact area 12 of the layer 11 resting on the platform preferably is made of a high-friction nonskid material, such as rubber or latex, which rests firmly on the floor.

To enable easy dispatch of the apparatus and simple storage, the supporting members can be pivotally secured to the platform 1 for rotation about an angle of about 90° thereby permitting the supporting members to be collapsed parallel with the platform. For this purpose, joints may be used which consist of a mounting shoe 13 and a pivot axis 14. Against the action of a spring 15, the supporting members 2 can be pivoted into a horizontal position.

FIG. 7 shows a front view of one embodiment of the gymnastic apparatus according to the invention, whereby the platform 1 and a supporting member 2 are shown in sectional view. In this embodiment, both platform 1 and supporting members 2 are plastic hollow moldings 16. The supporting members 2 are dimensioned such that they can accommodate the forces exerted by the resilient rope 5 but they will give way in the event of greater stress, for example due to the impact of a body.

The platform 1, in the form of a plastic hollow molding 16, preferably has a resilient cushioning effect. By means of reinforcements 17, the dimensional stability of the plastic hollow molding 16 is increased and the elasticity of the upper side of the platform 1 restricted. The cushioning and impact-absorbing effect of the platform can be influenced by filling the plastic hollow molding 16 with a resilient elastic material 18, for example, foam rubber or the like.

Figure 8:
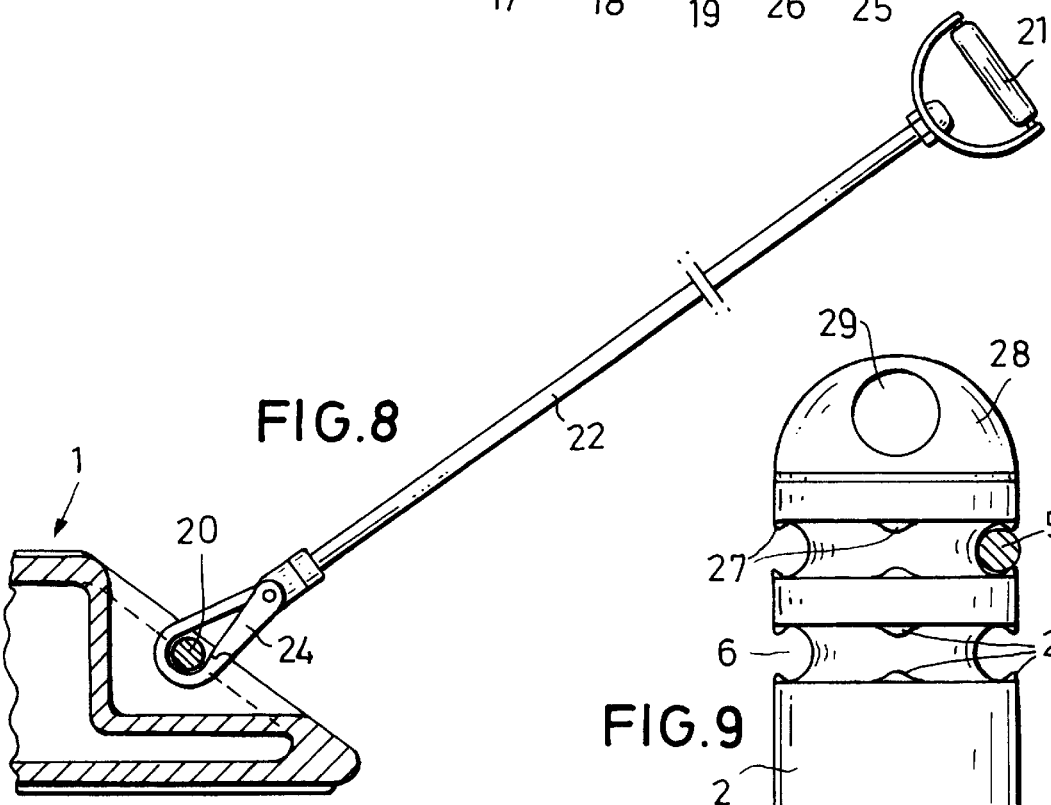
FIG. 8 a detailed view of an attachment lug.

The platform 1 preferably is coated on the upper and on the underside with a non-skid covering 19. To prevent a stumbling edge a border 23 preferably sloping upwards from below the plafform to the level of the upper side of the platform 1 is disposed at the longitudinal edges of the platform 1. As FIG. 8 shows, holding devices 20 may be provided at the edge of platform 1 onto which an expander belt 22 can be fitted. In one embodiment The expander belt 22 is affixed to a lug 20 by means of a carbine hook 24, however, other attachment means can be used. A grab handle 21 is provided on the free end of the expander belt 22 so that in particular the arms and arm muscles can be trained.

Attachment devices for the attachment of expander belt 22 can also be provided on the supporting members 2. In FIG. 7 the attachment device 20 shown is pointed in an outward direction. However, these attachment devices 20 also maybe fixed at any convenient location on the apparatus, for example, on the inner sides of the supporting members 2, or at the edges of platform 1.

As shown for the right supporting member 2 in FIG. 7, lower end of the supporting member 2 may contain a threaded stem 25 to enable speedy and secure attachment of the supporting member 2 which stem can be screwed into a female thread 26 molded in the four corner areas of the platform 1. Other means for secuing the supporting members to the platform also may be used, for example brackets or mortise and tenon style joints.

Figure 9:
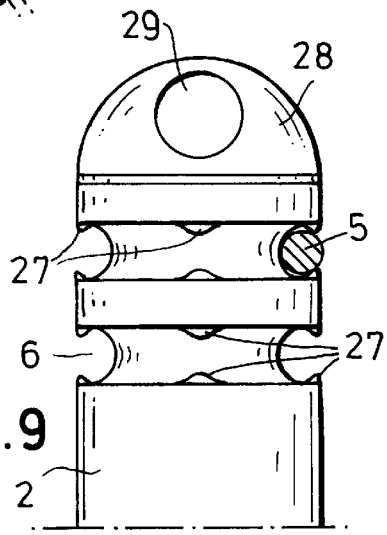
FIG. 9 a view of an upper section of one of the supporting members.

FIG. 9 shows an upper end of a supporting member 2 with two grooves 6 to accommodate a resilient rope 5 round in cross-section. In order that this resilient rope 5 surrounding the four supporting members 2 does not escape from grooves 6, nubs 27 are arranged at the edges of the grooves 6, which constrict the open cross-section to the grooves 6. Behind these nubs 27 the resilient rope 5 can slot in. At the upper end of the supporting member 2 a web wall 28 is arranged which has a round opening 29 for the formation of a lug.

After removal of the vertical supporting members 2 the platform 1 can also be used as so-called Aerobic Step or aerobic stepping device according to WO 93/00964. To adjust the height or inclination of the stepping surface 19 of the platform 1 feet 4 of varying height or height-adjustable feet 4 can be fixed or arranged at the underside of the platform 1. These feet 4 can be formed in by art recognized methods and can be inserted into the recesses provided on the underside.

As used herein, the term "resilient rope" is used to describe any elongated, rope-like member, e.g., a rope, belt, string, cord, band or other elongated flexible structure. The rope can be made of any resilient, elastic, stretchable material which will return substantially to its original configuration. Exemplary materials include, for example, elastic rubbers and plastic materials.

The gymnastic apparatus of the present invention permits a user to exercise the muscles of both the arms and legs without interrupting his or her exercise routine. This can be accomplished, for example, by grasping or otherwise engaging the resilient rope on the present invention with an arm or leg and pulling against or stretching the rope, thereby "working" the muscles of the arm and leg.

For example, the present apparatus can be used for exercising the leg and foot muscles in an exercise routine whereby the person training stands on the platform and either presses the resilient rope in an outward direction or pulls it inward with his or her calves, using the right or left leg alternatively. Furthermore, in doing so, the person training can raise the rope upward or push it downward using the foot or heel. The elasticity of the rope provides the resistance necessary to work the muscles of the leg.

To train the arm muscles, for example, the person training can kneel or lie on the platform and grasp the resilient rope with his or her hands and press outward or pull inward, or raise or lower the rope to work the arm muscles. Alternatively, the person training can sit or lie on the platform, grasp the expander belts attached to the platform and pull them to work the arm muscles.

The tension of the resilient rope can be adjusted in several ways. For example, the resilient rope can be looped more tightly about the support members to increase the tension, or the length of the rope can be adjusted, or a tension-controlling device, such as a winch, can be incorporated into the resilient rope, and tightened or loosened as desired. Other art-recognized methods for adjusting the tension also may be used in the present apparatus. Similarly, the expander belt can be adjusted to increase or decrease its tension.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. An exercise apparatus, comprising:

a rectangular platform;

elongate vertical supporting members secured to the platform at the four corners of the rectangular platform;

a resilient rope extending around the supporting members, wherein the rope is adjustable in height and is deformable to provide a stress element for exercising muscles, wherein each of said supporting members is provided with at least two grooves vertical arranged one above the other and adapted to at least partly receive said resilient rope for height adjustment of said member; and at least one securing device movable relative to said supporting members into an open and a closed position for retaining said rope at a set height when said securing device is in closed position.

2. The exercise apparatus according to claim 1, wherein each of the supporting members comprises a longitudinally extending slot adapted to receive the securing device, the securing device comprising a height-adjustable rod which extends in the slot, a knob and a plurality of hooks extending outwardly from said slot, wherein the number of hooks corresponds to the number of grooves and wherein the hooks are adapted to grip the resilient rope located in one of said grooves from the outside so as to retain the rope inside the groove.

3. The exercise apparatus according to claim 2, wherein said securing device is held in the open position by a spring catch.

4. The exercise apparatus according to claim 1, wherein a bottom side of said platform further comprises cushioning support members which are at least partially provided with a non-skid material.

5. The exercise apparatus according to claim 4, wherein said non-skid material is rubber or latex.

6. The exercise apparatus according to claim 1, wherein at least a portion of a bottom side of said platform further comprises a layer of a cushioning material.

7. The exercise apparatus according to claim 6, wherein said layer is made of at least one of foam or cellular rubber.

8. The exercise apparatus according to claim 6, wherein said layer has a contact area comprising a non-skid material.

9. The exercise apparatus according to claim 8, wherein said non-skid material is latex.

10. The exercise apparatus according to claim 1, wherein the supporting members are pivotally secured on said platform.

11. The exercise apparatus according to claim 10, wherein the supporting members can be rotated about an angle of about 90° and secured in the end positions.

12. The exercise apparatus according to claim 1, wherein said platform is in the form of a hollow molding.

13. The exercise apparatus according to claim 12, wherein said hollow molding is made of a plastic.

14. An exercise apparatus, comprising:

a rectangular platform, wherein said patform is in the form of a hollow molding and wherein said hollow molding is filled with a flexible material;

elongate vertical supporting members secured to the platform at the four corners of the rectangular platform; and resilient rope extending around the supporting members, wherein the rope is adjustable in height and is deformable to provide a stress element for exercising muscles.

15. The exercise apparatus according to claim 14, wherein said flexible material is a foam rubber.

16. An exercise apparatus, comprising:

a rectangular platform;

elonged vertical supporting members secured to the platform at the four corners of the rectangular platform, wherein said supporting members are hollow plastic moldings capable of flexing; and a resilient rope extending around the supporting members, wherein the rope is adjustable in height and is deformable to provide a stress element for exercising muscles.

17. The exercise apparatus according to claim 1, wherein at least one of a top or bottom surface of said platform is coated with a non-skid layer.

18. The exercise apparatus according to claim 1, further comprising at least one attachment member secured to said platform proximate to a marginal edge and adapted to receive an end of an expander belt provided with a grab handle.

19. The exercise apparatus according to claim 1, further comprising at least one attachment member secured to at least one of the supporting members and adapted to receive an end of an expander belt provided with a grab handle.

20. The exercise apparatus according to claim 1, wherein at least the opposing longer marginal edges of the rectangular platform are beveled so as to slope downwardly from a top surface of the platform to a height above a floor supporting said platform.

21. The exercise apparatus according to claim 1, wherein said grooves are provided with nubs arranged at outside edges of the grooves to restrict an opening width of the grooves to a value smaller than the maximum width of the grooves, so that the resilient rope is held captive in said grooves by said nubs.

22. The exercise apparatus according to claim 1, wherein an end of each of the supporting members is provided with a threaded portion adapted to engage with mating threaded portions arranged proximate to corners of the platform.

23. The exercise apparatus according to claim 1, wherein the rectangular platform has a length of between about 75 cm and about 150 cm and a width of between about 30 cm and about 50 cm.

24. The exercise apparatus according to claim 1, wherein the height of the resilient rope may be adjusted within a range of between about 10 cm and about 20 cm.

* * * * *